United States Patent [19]

Tamai et al.

[11] 4,033,890

[45] July 5, 1977

[54] LIQUID DEVELOPER FOR ELECTROPHOTOGRAPHY

[75] Inventors: Yasuo Tamai, Odawara; Satoru Honjo, Asaka; Sadao Osawa, Asaka; Masato Satomura, Asaka; Chiaki Osada, Asaka; Wakio Nagashima, Kanagawa; Naomitsu Takashina, Fujisawa, all of Japan

[73] Assignees: Fuji Photo Film Co., Ltd., Minami-ashigara; Mitsubishi Gas Chemical Company, Inc., Tokyo, both of Japan

[22] Filed: Feb. 26, 1975

[21] Appl. No.: 553,202

[52] U.S. Cl. ..... 252/62.1 L; 260/42.53; 260/33.6 SB; 96/1 LY

[51] Int. Cl.[2] ..... G03G 9/00

[58] Field of Search ..... 260/42.53, 827, 33.6 SB, 260/33.6 UA; 252/62.1, 63.7; 96/1 LY

[56] References Cited

UNITED STATES PATENTS

| | | | |
|---|---|---|---|
| 2,742,378 | 3/1956 | Te Grotenhius | 260/827 |
| 2,792,309 | 5/1957 | Teichmann | 260/827 |
| 2,891,911 | 6/1959 | Mayer et al. | 252/62.1 |
| 3,417,019 | 12/1968 | Beyer | 252/62.1 |
| 3,503,881 | 3/1970 | Shinohara | 260/827 |
| 3,563,916 | 2/1971 | Takashina | 260/827 |
| 3,629,117 | 12/1971 | Okuno | 260/827 |

*Primary Examiner*—John D. Welsh
*Attorney, Agent, or Firm*—Sughrue, Rothwell, Mion, Zinn and Macpeak

[57] ABSTRACT

Novel liquid developers contain in a carrier liquid a toner produced by graft-copolymerization of an addition-polymerizable monomer represented by the formula:

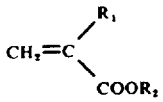

wherein $R_1$ represents a hydrogen atom or a methyl group and $R_2$ represents an alkyl group having 6 to 20 carbon atoms, an addition-polymerizable monomer having an alkoxysilane group or a phenoxysilane group, and carbon black. The carrier liquid has a high electric resistance and a low dielectric constant.

10 Claims, No Drawings

LIQUID DEVELOPER FOR ELECTROPHOTOGRAPHY

BACKGROUND OF THE INVENTION

1. Field of the Invention

This invention relates to electrophotography and more particularly to liquid developers containing a positively-charged developer powder.

2. Description of the Prior Art

Among the developers converting electrostatic latent images formed by electrophotography or electrostatic recording into visible images, a developer comprising a developer powder dispersed in an insulating a liquid is called "liquid developer" and in case of employing liquid developers images having higher sharpness and resolution as compared with other developers are obtained and even low contrast electrostatic images can be converted into distinct visible images. Furthermore, in such case it is easy to obtain liquid developers containing a toner particle having smaller particle sizes and thus, liquid developers are suitable for obtaining continuous-tone photographs.

Conventional liquid developers are prepared by dispersing pigments or dyes, such as phthalocyanine blue, carbon black, nigrosin type dyes, etc. in an insulating liquid, but when only pigment or dyes are incorporated in an insulating liquid, they will not, in many cases, retain electric charges of the desired polarity at a high level. Accordingly, the charges are controlled, for example, by further incorporating in the insulating liquid a resin soluble therein, a charge regulating agent, etc., or by coating the surface of the pigment or dye particles using an insulating resin which can be soluble or insoluble in the insulating liquid, in combination with the pigment or dye particles.

In these liquid developers, the charge regulating agents or resins are relatively strongly adsorbed on the surface of the pigment particles within a short period of time immediately after or after the production thereof so that satisfactory dispersion and satisfactory charge of a toner are maintained. However, as the time elapses, the adsorbed material is gradually split off from the pigment particles. As a result, the developability which is obtained immediately after the preparation of a liquid developer can not be kept over a long period of time in many cases.

In order to eliminate the disadvantages described above, the use of a graft-carbon type liquid developer has been proposed. The term "Graft-Carbon" (Trademark, made by the Mitsubishi Gas Chemical Co., Ltd.) refers to pigment particles, especially carbon black particles, to the surface of which a vinyl polymer or a copolymer has been graft-copolymerized. Graft-carbon is described in detail in *Nippon Gomu Kyokaishi* (Journal of Rubber Association, Japan), vol. 38, January, pages 13–22; *Kobunshi* (High Molecular Weight Compound), Vol. 17, pages 822–827; U.S. Pat. No. 3,557,040; Japanese Patent Publication No. 17284/70; etc. It is also known to use graft-carbon as a toner. See *Kobunshi*, vol. 14, September, pages 746, 749 (1965); Brochure published by the Mitsubishi Gas Chemical Co., Ltd., "graft-Carbon", page 3; etc. A number of liquid developers for electrophotography have been proposed using graft-carbon based on the disclosure of the publications above. Examples of such liquid developers can be found in, for example, Japanese Patent Publication Nos. 27597/68, 19196/69, 6151/71, 6152/71, 6155/71, 6156/71, 8278/71, 6157/71, 4438/72, 4439/72, etc.

However, we have found that these graft-carbon type liquid developers are not always satisfactory. For instance, it is difficult to disperse in isoparaffin type carrier liquids the graft carbon type liquid developers as are described in Japanese Patent Publication No. 19196/69 and therefore it is necessary to employ a kneading step. The graft-carbon type liquid developers as are described in Japanese Patent Publication No. 19196/69 have a disadvantage that charges of a toner are unsatisfactory in the carrier liquid. Other liquid developers which have been proposed heretofore do not result in high optical density of images. When a latent electrostatic image produced on a sensitized zince oxide layer was developed using these liquid developers, the maximum reflection intensity of the image obtained was 1.35 to 1.65. Since the maximum reflection intensity of original prints to be copied is usually higher than 2, it is impossible to produce a satisfactory image as far as these liquid developers are employed. In the processes as are described in the patents above, a monomer is usualy employed to assist the dispersion of the toner in the carrier phase (hereafter merely referred to as a dispersing monomer) in combination with a monomer to give the toner a charge (hereafter merely referred to as a polar monomer). We have found that if a sufficient amount of charge is to be given, a large amount of polar monomer must be copolymerized and as a result the stability of the dispersion tends to be poor.

These graft-carbon developers having relatively good developability can be obtained in case that the graft-carbon is dispersed immediately after the production thereof. However, if the developers are prepared using graft-carbon which has been allowed to stand for some time after the production of graft-carbon, an unsatisfactory dispersion often occurs. When graft-carbons are stored at higher temperatures, such a phenomenon that an unstable dispersion tends to occur is often observed. Although the reason is not clear, the phenomenon is believed to occur due to the selection of polar monomers to be copolymerized with the dispersing monomer. Further, this is concerned with either the stability of or interaction between the polar monomer moieties.

In addition, we have found that images which are obtained by the use of a toner produced using these toners having polar monomer moieties offered heretofore are insufficient in weather-resistance, although it is assumed to be also due to the unstableness of the polar monomer moieties. In particular, it is seriously disadvantageous when a steel plate having thereon an electro-photographic image is used after exposure to sunlight for a long period of time.

SUMMARY OF THE INVENTION

It is an object of the present invention to provide a liquid developer having a high preservability in the form of the graft copolymer (i.e., the state prior dispersion in a carrier liquid).

It is a further object of the present invention to provide a liquid developer containing a toner carrying a positive charge and capable of giving an excellent weatherproof image.

It is another object of the present invention to provide a liquid developer having superior dispersing properties and capable of giving high optical density of images.

It is another object of the present invention to provide a liquid developer in which a graft-copolymer type toner is contained.

The present invention relates to a liquid developer for electrophotography in which the carrier liquid has a high electric resistance and a low dielectric constant and contains a toner produced by the graft copolymerization of an addition-polymerizable monomer (A) shown by the formula (I):

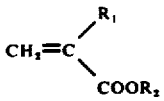

where $R_1$ represents a hydrogen atom or a methyl group, and $R_2$ represents an alkyl group having 6 to 20 carbon atoms; an addition-polymerizable monomer (B) having an alkoxysilane group or a phenoxysilane group, and pigment particles.

DETAILED DESCRIPTION OF THE INVENTION

Many pigments can be used in the liquid developer of the present invention. Typical examples of pigments which result in preferred effects includes carbon black, aniline black, alkali blue, phthalocyanine blue and phthalocyanine green. Among others, carbon black is especially advantageous since it is more easily subjected to the graft-copolymerization.

The addition-polymerizable monomer (B) imparts a positive electric charge to the toner when it is graft copolymerized. In general, when the proportion of a polar monomer is too low as compared with that of the dispersing monomer, it is difficult for the polar monomer to impart sufficient amount of an electric charge to the tone particles. However, as the monomer (B) which is the polar monomer in this invention has an excellent ability to polarize a toner, 1 part by weight of monomer (B) can be copolymerized with up to 45 parts by weight of the monomer (A). If the amount of the monomer (A) is greater than the value, the charge on the toner tends to become insufficient.

The addition polymerizable monomer (A) has a function to disperse a toner in the carrier liquid when it is graft copolymerized. Accordingly, if the amount of monomer (A) is too low compared with that of monomer (B), the dispersibility of the toner decreases. In this invention, more than about 5 parts by weight of the monomer (A) per one part by weight of monomer (B) is required to obtain a satisfactory dispersion. When the amount of monomer (A) is less than this value, the toner particles are aggregated in the carrier liquid.

It has been found from these results above that when 5 to 45 parts by weight of addition polymerizable monomer (A) are employed per 1 part by weight of addition polymerizable monomer (B), a preferred toner is obtained.

In addition, if $R_2$ in the formula (I) described above is an alkyl group having 5 or less carbon atoms, the use of such monomer (A) does not give the desired dispersibility. On the other hand, monomer (A) in which $R_2$ is an alkyl group having 21 or more carbon atoms is not easily available and disadvantageous from an economical standpoint.

It has also been found that the ratio of the total amount of monomer (A) and monomer (B) which meets the above requirements to the amount of pigment particles also influences the optical density of image, the fixing property of image, etc. As the total amount of monomers (A) and (B) decreases, the optical density of the image tends to increase and the fixing ability tends to decrease. Also, when the toner particles having a low monomer proportion are dispersed in a liquid carrier, the toner particles tend to precipitate easily even if they do not aggregate. If the total amount of monomers (A) and (B) increases, the fixing abilities increase but the optical density of the image obtained decreases. We have thus found that the amount of the pigment should not exceed about 6 parts by weight per 1 part by weight of the total amount of monomers (A) and (B). We have further found that when the pigment is used in an amount of less than 0.2 part by weight per 1part by weight of the monomers, the optical density of the image becomes too low. The decrease in the optical density of the image is particularly remarkable both when the developing time is short and when the electrostatic contrast is low.

It is preferred to use a carrier liquid having an electrical resistance of at least $10^{10}$ ohm-cm and a dielectric constant of lower than about 3. Typical examples of such materials include straight chain aliphatic hydrocarbons such as octane, nonane, and decane; branched chain aliphatic hydrocarbons such as iso-octane and iso-nonane; alicyclic hydrocarbons such as cyclohexane, and decalin; and chlorofluorohydrocarbons such as difluorotetrachloroethane, and trifluorotrichloroethane. It is more preferred from an industrial view point to use such inexpensive materials as kerosene, gasoline, ligrain, mineral spirits, etc. A most preferred carrier liquid is an isoparaffinic mixture solvent. One of such a mixed solvent is commerically available by the trade name "Isopar" produced by Esso Standard Oil Company.

The liquid developer of the present invention may further contain a small amount of a charge regulating agent. The graft-type toner of the present invention, of course, gives a sufficient amount of positive charge without incorporating a charge regulating agent. However, the incorporation of a charge regulating agent improves the resistance to possible contamination by impurities. This is particularly effective in the case of marking on a steel plate where contamination by foreign matter is often unavoidable. Preferred examples of charge regulating agents include various metallic soaps as described in U.S. Pat. No. 3,529,581, e.g., manganese linolenate, cobalt naphthenate, manganese resinate, and cobalt oleate; metallic salts of 2-ethylhexanoic aicd, and borates and silicates of long chain alcohols as described in Japanese Patent Publication No. 20868/66. The amount of the charge regulating agent to be added to the carrier liquid generally ranges from about 0.001 to about 5 parts by weight per 1,000 parts of the carrier liquid.

The graft-copolymerized type toner of the present invention is used in combination with a carrier liquid, in an amount of about 0.1 to about 20 parts by weight of the toner per 1,000 parts by weight of the carrier liquid. The use of about 0.5 to 10 parts by weight of the toner to the liquid is particularly preferred to provide images having a high optical density with less fogs.

Addition polymerizable monomer (B) having an alkoxysilane or phenoxysilane used in this invention is represented by following formula (II) or (III).

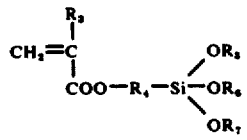

(II)

wherein $R_3$ is a hydrogen atom or a methyl group, $R_4$ is an alkeylene group having 1 to 8 carbon atoms, and $R_5$, $R_6$ and $R_7$ each is an alkyl group having 1 to 4 carbon atoms or a phenyl group;

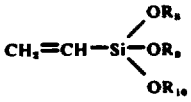

(III)

where $R_8$, $R_9$ and $R_{10}$ each is a phenyl group, an alkyl group having 1 to 4 carbon atoms or $-CH_2-CH_2-OR_{11}$ wherein $R_{11}$ represents a phenyl group or an alkyl group having 1 to 4 carbon atoms.

Addition polymerizable monomer (A) of formula (I) can be used in the combination with any one of monomers (B) represented by formulae (II) and (III). Of course, all three monomers, i.e., the monomers (I), (II) and (III) may be copolymerized together. Any one of the monomers represented by formulae (II) and (III) has excellent copolymerizing property. When the monomers are graft-copolymerized with pigments, an effective positive charge can be given to the toner. In particular, the toner can be stably stored for a long period of time in the form of a graft copolymer, that is, the paste state prior to preparing a liquid developer by diluting the pasty toner. That is, when the graft carbon obtained using monomer (B) represented by formula (II) or (III) and monomer (A) represented by formula (I) is stored under severe conditions for a long period of time, e.g., at 40° C. for 3 months, the graft carbon particles undergo neither aggregation nor gelation. In addition, the images obtained using these toners are stable, particularly when a monomer having an alkoxysilane group or a phenoxysilane group is used the image is extremely stable in long open-air exposure.

These excellent results are assumed to be due to the introduction of silicon atoms into the side chain of the graft-copolymer and due to the effect of the phenoxy group of the alkoxyl group present therein. Typical examples of the monomer (B) represented by formulae (II) and (III) are: γ-trimethoxysilane-n-propylmethacrylate, γ-triethoxysilane-n-propylmethacrylate, γ-trimethoxysilane-tert-butylmethacrylate, γ-trimethoxysilane-ethylacrylate, γ-trimethoxysilane-ethylhexylacrylate, vinvyl-tri-β-(methoxyethoxy)silane, vinyl-tri-β-(methoxymethoxy)silane, vinyl-tri-β-(methoxyphenoxy)silane, vinyl-trimethoxysilane, vinyl-triethoxysilane, vinyl-tri-butoxysilane, vinyl-triphenoxysilane, etc.

The present invention will be explained in detail with reference to the examples below, but is not limited to the description. The numerical values, ratios, compositions or the like can be modified within the scope of the present invention. All parts are by weight unless otherwise indicated.

EXAMPLE 1

| EXAMPLE 1 | |
|---|---|
| Carbon black (Elftex No. 8, Cabot Co.) | 20 parts |
| Lauryl methacrylate | 20 parts |
| Vinyltrimethoxysilane | 2 parts |
| Azobisisobutyronitrile | 0.3 part |
| Toluene | 50 parts |

A mixture of the components shown above was reacted at 85° C. for 10 hours under an atmosphere of nitrogen to provide a black viscous graft-carbon copolymer. In 1,000 parts of Isopar H (an isoparaffinic solvent manufactured by Esso Standard Oil Company, aniline point 83° C., initial boiling point 174° C., drying point 180° C.) was dispersed 8 parts of the copolymer thus prepared by applying ultrasonic waves to produce a liquid developer containing positively charged toner particles dispersed therein. A sensitized zinc oxide paper was subjected to negative corona discharge in the dark and then imagewise exposed through a positive original to form an electrostatic latent image on the paper. The surface of the sensitized paper was wetted with Isopar H containing no toner and thereafter developed in the liquid developer described above. A clear positive image having a soft black tone and a high density was obtained and the maximum optical density of the image was 1.87.

When the liquid developer above was stored at 35° C. for three months and the same procedures as above were repeated, the maximum optical density of the images obtained was 1.75.

EXAMPLE 2

After storing the graft carbon copolymer obtained in Example 1 for 3 months at 35° C., the copolymer was diluted with Isopar H in the same manner as in Example 1 to provide a liquid developer. When a latent image was developed with the developer, the maximum optical density of the images was 1.81. The images obtained were clear as in Example 1.

EXAMPLES 3 and 4

A graft carbon copolymer was prepared in a similar manner to Example 1 except the vinyl-tri-β-(methoxyethoxy)-silane and γ-methacryloxypropyltrimethoxysilane each was used instead of vinyltrimethoxysilane. These graft carbon copolymers were toners for the liquid developer capable of forming clear positive images having a soft black tone.

When the toners were stored in the state without being diluted with a carrier liquid, no substantial change in efficiency was observed.

EXAMPLE 5

The same procedures were repeated as in Example 1 except that 18 parts of the same carbon black and 2 parts of phthalocyanine blue were employed in lieu of 20 parts of the carbon black.

The liquid developer obtained by applying the same procedures as in Example 1 provided positive images having excellent clearness and a hard black tone.

EXAMPLE 6

To 1,000 parts of the liquid developer obtained in Example 1 was added 0.1 part of cobalt naphthenate.

The developer thus prepared provided superior images having less streak and less fog than in Example 1.

EXAMPLE 7

A graft carbon copolymer was prepared in a similar manner to Example 1 except that a mixture of 10 parts of lauryl methacrylate and 10 parts of cetyl acrylate was used instead of 20 parts of lauryl methacrylate.

A liquid developer prepared using the above copolymer provided excellent positive images.

COMPARATIVE EXAMPLE

A graft carbon copolymer was prepared in a similar manner to Example 1 except that a solvent mixture of toluene and n-butyl alcohol was used instead of vinyl-trimethoxysilane. Using the thus obtained graft carbon copolymer a liquid developer was prepared in a similar manner to Example 1. Then similar development to Example 1 was performed. The maximum optical density of the images obtained using the liquid developer was 1.80.

After the developer was stored at 35° C. for 3 months, a similar development was repeated. The maximum optical density was 1.53.

The graft-carbon copolymer obtained was maintained at 35° C. for 3 months. Thereafter, the copolymer was attempted to be diluted with Isopar H by applying ultrasonic waves. However, the toner particles aggregated partially and thus a complete dispersion could not be obtained in this case.

Then, 8 parts of this copolymer was kneaded in a ball mill for 20 hours together with 12 parts of a 1:1 mixture of kerosine and toluene. Thereafter, the mixture was diluted with 100 parts of Isopar H to form a liquid developer. The maximum optical density of images obtained using the liquid developer was 1.32.

Similar insufficiency in dispersion was also observed when acrylamide was used instead of vinyl-trimethoxysilane.

While the invention has been described in detail and with reference to specific embodiments thereof, it will be apparent to one skilled in the art that various changes and modifications can be made therein without departing from the spirit and scope thereof.

What is claimed is:

1. An electrophotographic liquid developer comprising an insulating carrier liquid having a high electric resistance and a low dielectric constant and a toner in a proportion of about 0.1 to about 20 parts by weight of said toner per 1,000 parts by weight of said carrier liquid, said toner comprising the graft-copolymer of (a) and addition-polmerizable monomer (A) represented by the formula:

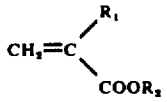

where $R_1$ represents a hydrogen atom or a methyl group and $R_2$ represents an alkyl group having 6 to 20 carbon atoms, and (b) an addition-polymerizable monomer (B) having an alkoxysilane group or a phenoxysilane group, and pigment particles selected from the group consisting of carbon black, aniline black, alkali blue, nigrosine, phthalocyanine blue and phthalocyanine green, with the proportion of addition polymerizable monomer (A) to addition polymerizable monomer (B) being 5 to 45 parts by weight of addition polymerizable monomer (A) per 1 part by weight of addition polymerizable monomer (B) and with the amount of addition polymerizable monomer (A) and addition polymerizable monomer (B) grafted to the pigment particles being sufficient to provide the pigment particles with an effective positive charge.

2. The developer of claim 1 wherein said addition-polmerizable monomer (B) is represented by the formula:

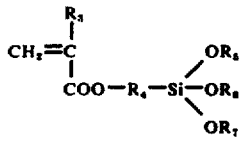

where $R_3$ is a hydrogen atom or a methyl group, $R_4$ is an alkylene group having 1 to 8 carbon atoms, and $R_5$, $R_6$ and $R_7$ each is an alkyl group having 1 to 4 carbon atoms or a phenyl group; or

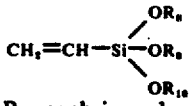

where $R_8$, $R_9$ and $R_{10}$ each is a phenyl group, an alkyl group having 1 to 4 carbon atoms or a $-CH_2-CH_2-OR_{11}$ group wherein $R_{11}$ represents a phenyl group or an alkyl group having 1 to 4 carbon atoms.

3. The developer of claim 1, where said insulating liquid carrier has an electrical resistance of at least $10^{10}$ ohm-cm and a dielectric constant of lower than 3.

4. The developer of claim 3, where said insulating liquid carrier is a straight chain aliphatic hydrocarbon, a branched chain aliphatic hydrocarbon, a chlorofluorohydrocarbon, kerosene, gasoline, ligroin, mineral spirits or an isoparaffinic solvent mixture.

5. The developer of claim 1, where a charge regulating agent is additionally present, said charge regulating agent being selected from the group consisting of metallic salts of 2-ethylhexanoic acid, and borates or silicates of long chain alcohols.

6. The developer of claim 4, where said charge regulating agent is manganese linolenate, cobalt naphthenate, manganese resinate, cobalt oleate, a metal salt of 2-ethylhexanoic aicd or a borate or silicate of a long chain alcohol.

7. The developeer of claim 1, where said addition-polymerizable monomer (B) is γ-trimethoxysilane-n-propyl methacrylate, γ-triethoxysilane-n-propylmethacrylate, γ-trimethoxysilane-tert-butylmethacrylate, γ-trimethoxysilane-ethylacrylate, γ-trimethoxysilane-ethylhexylacrylate, vinyl-tri-β-(methoxyethoxy)silane, vinyl-tri-β-(methoxymethoxy)silane, vinyl-tri-β-(methoxyphenoxy)silane, vinyl-trimethoxysilane, vinyl-triethoxysilane, vinyl-tributoxysilane or vinyl-triphenoxysilane.

8. The developer of claim 1, where said addition-polymer-polymerizable monomer (A) is lauryl methacrylate or cetyl acrylate.

9. The developer of claim 1, wherein the amount of the pigment particles to the amount of the addition polymerizable monomers (A) and (B) ranges from about 0.2 to about 6 parts be weight of said pigment particles per 1 part by weight of said addition polymerizable monomers (A) and (B).

10. The developer of claim 5 wherein 0.001 to about 5 parts by weight of charge regulating agent is added per 1,000 parts of carrier liquid.

* * * * *